US006629664B2

(12) United States Patent
Weijenborg

(10) Patent No.: US 6,629,664 B2
(45) Date of Patent: Oct. 7, 2003

(54) FLYING REEL CHANGER IN A WEB-FED ROTARY PRINTING MACHINE

(75) Inventor: Antoon Weijenborg, Deurne (NL)

(73) Assignee: Heidelberger Druckmaschinen AG, Heidelberg (DE)

( * ) Notice: Subject to any disclaimer, the term of this patent is extended or adjusted under 35 U.S.C. 154(b) by 6 days.

(21) Appl. No.: 10/006,428

(22) Filed: Dec. 7, 2001

(65) Prior Publication Data

US 2002/0104450 A1 Aug. 8, 2002

(30) Foreign Application Priority Data

Dec. 7, 2000 (DE) ..... 100 60 757

(51) Int. Cl.[7] ..... B65H 19/16; B65H 19/18

(52) U.S. Cl. ..... 242/554.5; 242/552; 242/555.5; 242/554.4

(58) Field of Search ..... 242/552, 554.5, 242/554.6, 555.5, 555.6, 555.7, 554.4; 156/504, 157

(56) References Cited

U.S. PATENT DOCUMENTS

| | | | | |
|---|---|---|---|---|
| 4,077,580 A | * | 3/1978 | Lang et al. | 242/554.6 |
| 4,100,012 A | * | 7/1978 | Meihofer et al. | 242/552 |
| 4,543,152 A | | 9/1985 | Nozaka | |
| 4,655,865 A | | 4/1987 | Nozaka | |
| 5,190,234 A | * | 3/1993 | Ezekiel | 242/552 |
| 5,253,819 A | | 10/1993 | Butler, Jr. | |
| 5,732,903 A | * | 3/1998 | Madrzak | 242/554.5 |
| 6,096,150 A | * | 8/2000 | Ohno | 242/554.6 |

FOREIGN PATENT DOCUMENTS

| | | |
|---|---|---|
| DE | 1 046 471 | 12/1958 |
| DE | 1 104 974 | 4/1961 |
| DE | 199 19 759 A1 | 11/2000 |
| EP | 1 004 528 A1 | 5/2000 |
| GB | 2 204 026 A | 11/1988 |

* cited by examiner

*Primary Examiner*—John M. Jillions
(74) *Attorney, Agent, or Firm*—Laurence A. Greenberg; Werner H. Stemer; Ralph E. Locher

(57) ABSTRACT

A flying reel changer includes first drive means for rotating the new paper reel at a minimum splice speed and second drive means for accelerating the old paper reel from either standstill or crawl speed to a speed which substantially corresponds to the minimum splice speed. The flying reel changer includes actuating means that, while the old paper reel is being accelerated from the first state, moves the dancer roll such that a substantially uniform tension is maintained in the paper web. The flying reel changer also includes joining means that joins the old paper web and the new paper web together while the old paper web and the new paper web are moving at the minimum splice speed.

13 Claims, 2 Drawing Sheets

FLYING REEL CHANGER IN A WEB-FED ROTARY PRINTING MACHINE

BACKGROUND OF THE INVENTION

Field of the Invention

The invention relates to a flying reel-changer in a web-fed rotary printing machine, with which a reel change can be carried out during standstill operation or during crawl operation of the web-fed rotary printing machine.

Flying reel changers are known in the prior art and are used in web-fed rotary printing machines—that is to say in printing machines in which the paper web to be printed is unrolled from a feed reel and is supplied to the printing units for the printing operation. In a web-fed rotary printing machine, a flying reel changer is used for connecting the web start of a new paper reel to the outgoing reel during the continuous printing operation of the printing machine, without interrupting the running paper web, when the paper supply on the outgoing old paper reel approaches its end.

The disadvantage in the flying reel changers disclosed by the prior art is that a flying reel change can be carried out only during the continuous printing operation of the printing machine, but not during standstill or crawl operation, at which the printing material web is moved at only a few centimeters per second.

However, such a change from the outgoing old paper reel to a new paper reel can be desirable in the case of specific print jobs. For example, if a preceding print job has been completed and only a small quantity of paper still remains on the old paper reel, the next reel change would be required soon. In such a case, there is the risk that when the printing machine at is run up again at the start of the new print job, web breaks can easily occur because of web tension fluctuations associated with a reel change and arising from the complicated dynamic control operations.

In addition, an early change from the old paper reel to a new paper reel during standstill operation or during crawl operation of the printing machine can be required if different paper grades or web formats are processed during the preceding print job and the following print job.

SUMMARY OF THE INVENTION

It is accordingly an object of the invention to provide a flying reel changer and a method of joining the start of a paper web of a new reel to an old paper web which overcomes the above-mentioned disadvantages of the prior art apparatus and methods of this general type. In particular, it is an object of the invention to provide a flying reel changer in a web-fed rotary printing machine, in particular in a web-fed rotary offset printing machine for newspaper printing, with which a reel change can be carried out even during standstill operation of the printing machine, with high reliability and in the shortest possible time.

With the foregoing and other objects in view there is provided, in accordance with the invention, a flying reel changer for joining the beginning of a new paper web of a new paper reel to an outgoing old paper web of an old paper reel that is led over a dancer roll. The flying reel changer has first drive means that, during the standstill of the printing machine or during the crawl operation of the same, rotates the new paper reel at a minimum splice speed. The device further includes second drive means which accelerates the old paper reel, which is at a standstill or moving at crawl speed, that is to say at a circumferential speed in the range of 0.1 m/s, for example, to a speed which substantially corresponds to the minimum splice speed. In order to accommodate the sag in the paper web which occurs in this case, the dancer roll is moved or moves in the corresponding direction, preferably at the same time that the old paper reel is accelerated to the splice speed, in such a way that a substantially uniform tension is maintained in the old paper web in the region of the reel changer. The actuating means can advantageously be formed by a pneumatic cylinder, which is fed from a compressed air source with a preferably large capacity, and which inserts a constant and preferably substantially position-independent force on the old paper web. The device according to the invention further includes joining means, which joins the old paper web and the new paper web to each other while the paper webs are moving at the minimum splice speed and while the dancer roll is being moved by the actuating means.

The flying reel changer provides the advantage that the splicing operation, that is to say sticking the beginning of the web of the new paper reel to the old paper reel, can be carried out during standstill or during the very slow crawl operation of the printing machine, at which the printing machine is generally moved only centimeter by centimeter. In this way, after a print job has been completed, as early as the preparation phase for the new print job, that is to say, for example, while changing the printing plates, the old paper reels can be replaced at the same time, without having to put the printing machine into a printing operation at a high continuous printing speed in order to replace the old paper reel. This is particularly advantageous when there is only a small supply of paper on the old outgoing paper reel which, when the printing machine is run up again for a print job, would lead to a flying reel change as the machine was being run up. Numerous control parameters, which change dynamically, have to be monitored by the central open-loop and closed-loop control device, in particular when the printing machine is being run up.

A further advantage is that, in the event of a format change between a preceding print job and a new job, the new paper reel or reels for the other format can be changed automatically at a standstill, while, for example, the printing units are being fitted with new printing plates.

In accordance with an added feature of the invention, the first paper reel is first accelerated by the first drive means, which can be, for example a controlled-position and/or a controlled-speed electric motor, to a minimum synchronization speed, and is then rotated, preferably for a certain time, for example, a few seconds, at this minimum synchronization speed. Then, the new paper reel is braked down, for example by braking means, for example, a known disc brake, or else by means of suitably energizing the first drive means, from the minimum synchronization speed to the minimum splice speed. This results in the advantage that the minimum splice speed can be reached and regulated with increased accuracy and in a comparatively shorter time than is possible in the case of accelerating the new paper reel directly up from a standstill.

In order to keep the travel of the dancer roll as small as possible, which has preferably been moved into its zero position at the start of the reel change, that is to say at the end of the preceding print job, in accordance with a further embodiment of the invention, the second accelerating means can accelerate the old paper reel only when the new paper reel has reached the minimum splice speed. In the same way as the first accelerating means, the second accelerating means can preferably be driven by a controlled-position and/or a controlled-speed electric motor.

The joining means preferably includes a pressure roll, which presses the old paper web onto the new paper roll after the old paper reel and the new paper reel have been moving for a certain time, for example, for one to two seconds, at the minimum splice speed. The new paper roll is provided with an adhesive section, for example, a double-sided adhesive tape to adhere to the old paper web.

In accordance with an additional feature of the invention, the joining means includes a pressing device formed as a pressure roll, a brush roll, or a brush strip.

Pressing the old paper web onto the new paper reel, which is provided with an adhesive section at the beginning of the paper web is advantageously carried out as a function of the position of the new paper reel. The position of the new paper reel is determined using one or more sensors, which detect markings applied to the new paper reel. The markings can be, for example, metal strips or colored markings, which are registered by appropriately designed sensors. The markings, can be arranged within the adhesive section, for example, within the adhesive tape, or can even be formed by the adhesive tape itself.

The time at which the new paper reel is braked down from the minimum synchronization speed to the minimum splice speed can be arranged to be at a predefined time interval following the detection of the marking on the new paper reel, and this time interval preferably is adjustable.

In the same way, the sensor signal, which generally corresponds with the leading edge of the paper web that is wound up on the new paper reel, can be used to control a splicing or impact knife that severs the old paper web during the joining action or at a short time after the joining action of the old and new paper webs by means of the pressure roll. During the joining action, the old and the new paper webs are moving at the minimum splice speed.

With the foregoing and other objects in view there is provided, in accordance with the invention, a method for joining the beginning of a new paper web of a new paper reel to an outgoing, old paper web of an old paper reel in a flying reel changer for a web-fed rotary printing machine during standstill operation or during crawl operation of the printing machine. The old paper web is led over a dancer roll. The new paper reel is first rotated at a minimum splice speed. The old paper reel is accelerated, from a standstill or from a speed corresponding to the crawl speed of the printing machine, to a speed that substantially corresponds to the minimum splice speed, and the dancer roll is moved simultaneously in such a way that a substantially uniform tension in the paper web is set or one is maintained, and then the old paper web and the new paper web are joined to each other while the webs are moving at the minimum splice speed.

As a result of using the method which can be implemented, for example, in the form of software control in the central control device of a web-fed rotary printing machine, the down time of the printing machine after completion of a print job can be used for a reel change without taking up any additional time. The software implementation of the method by means of appropriate programming of the central control and regulating device of the printing machine or that part of the control and regulating device which is associated with the flying reel changer, results in the possibility of retro-equipping the method in a cost-effective way with few mechanical changes, even in older printing machines.

In accordance with an added mode of the invention, the new paper reel is first accelerated to a minimum synchronization speed which, for example, can lie in the region of approximately 0.5 m/s, and is then braked down from the minimum synchronization speed to the minimum splice speed. This results in the advantage that, in the case of large paper reels with a large moment of inertia, the splice speed can be reached within an extremely short time without using complicated, powerful drives, by using known braking devices, such as disc brakes, or by appropriately energizing an electric drive motor that drives the new paper reel.

Furthermore, if the sensor for detecting the marking on the new paper reel is arranged at a short distance from the splice head, this results in the advantage that the splicing operation as a whole can be carried out in a very short time, since the new paper reel no longer has to carry out a complete revolution when the time period between the detection of the marking and the splicing operation is no longer sufficient to calculate, in advance, the various times at which the individual actions are carried out during the splicing operation. For example, the new paper reel needs about 20 to 30 seconds for a complete revolution, which, when the new paper reel is accelerated to the minimum synchronization speed, accordingly saves time.

In accordance with an additional mode of the invention, the acceleration of the old paper reel—which because of its small diameter and its low mass, can be accelerated considerably more quickly and without the use of powerful motors—is accelerated only when the new paper reel has reached the minimum splice speed. Here, the minimum splice speed can be in the range of 0.1 m/s to 0.4 m/s, for example, but is not restricted to the values mentioned.

In accordance with another mode of the invention, the old and the new paper web can be joined by pressing the old paper web onto the new paper reel where the new paper web has been provided with an adhesive section, for example with double-sided adhesive tape, preferably in the region of the leading paper web edge. To detect the position of the adhesive section on the new paper reel—and, moreover, its position and/or speed—one or more sensors are preferably used in order to optimize the splice operation. These sensors register a marking, which has been applied to the new paper web in the area of the leading edge of the web, by optical and/or inductive means. The signals from the sensor or sensors are then fed to the central control device of the printing machine or of the flying reel changer. These signals are used to determine the optimum time for braking the new paper reel down from the minimum synchronization speed to the minimum splice speed, the optimum time for accelerating the old paper reel to the minimum splice speed, the optimum time at which the pressure roll is set against the new paper reel, and the time at which the old paper web is severed upstream of the joining point, which is preferably carried out in the same way as the determination of the other times by a calculation that is performed by a central control and regulating device.

Other features which are considered as characteristic for the invention are set forth in the appended claims.

Although the invention is illustrated and described herein as embodied in flying reel changer in a web-fed rotary printing machine it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
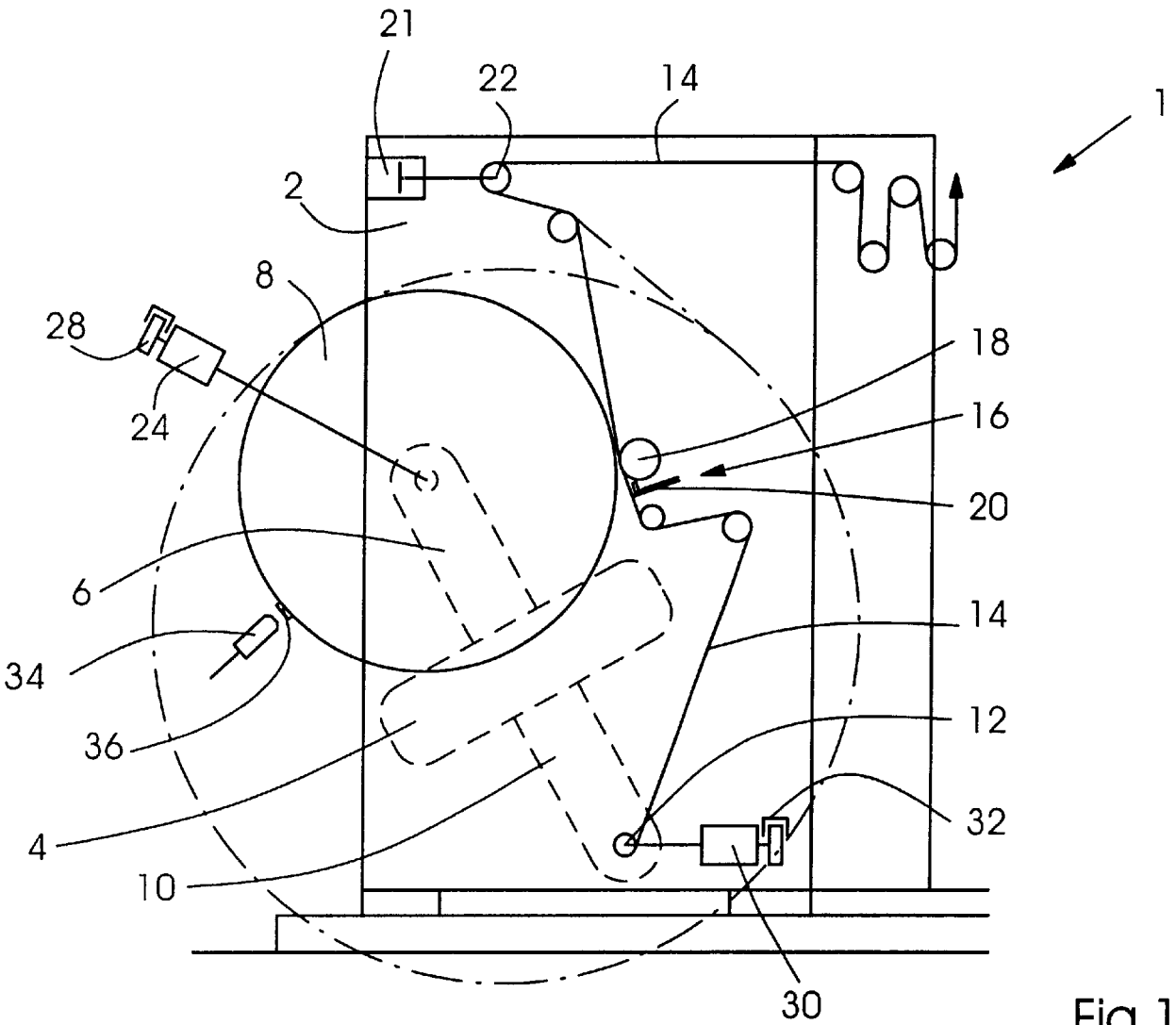
FIG. 1 schematically shows a side view of a flying reel changer.

Referring now to the figures of the drawing in detail and first, particularly, to FIG. 1 thereof, there is shown a flying reel changer 1 that includes a support or frame 4 which can be rotated in the housing 2 of the flying reel changer 1. The frame 4 has a first carrying arm 6 for a new paper reel 8 and a second carrying arm 10 for an old outgoing paper reel 12.

The old paper web 14 running off the old reel 12 is led over a deflection roll (not specifically designated) in the direction of the splice head 16, which includes a pressure roller or bonding roller 18, and an impact knife 20. The impact knife 20 is configured upstream of the bonding roller 18, for severing the old paper web 14 after the joining operation, also referred to below as the splicing operation.

The old paper web is guided past the new paper reel 8 and the splice head 16 in the direction of a dancer roll 22, which is operated by pneumatic cylinders 21 indicated schematically. The dancer roll 22 and the pneumatic cylinders 21 act on the old paper web 14 with a substantially constant force in order to produce a constant web tension. The old paper web 14 is then led over further pull rolls (not specifically designated) and deflection rolls in the direction of the printing units.

As is further indicated schematically in FIG. 1, the reel changer 1 includes first drive means for driving the new paper reel 8. The first drive means includes a first drive motor 24 in the form of an electric motor acting, for example, on the clamping cone of the reel core.

In order to be able to brake the new paper reel 8 down from a higher speed to a lower speed, braking means 28 are also provided which, in FIG. 1, are represented schematically by a brake disc and a stylized brake carrier. However, the braking means 28 can be formed in the same way by the first electric motor 24, if the latter is energized in such a way that it exerts a braking torque on the new paper reel 8.

A second electric motor 30 is preferably coupled to the clamping cone of the winding shaft of the new paper reel 12, in order to accelerate the latter to a predefined speed.

A braking means 32, illustrated by the stylized disk brake, is provided for braking the old paper reel 12. The second drive motor 30 can likewise be used as the braking means 32 for braking the old paper reel 12 by appropriately energizing the second drive motor 30.

Performing a splice during standstill operation of the printing machine will be described below using FIG. 2 in which the machine is at a standstill, $V_{press}$ specifies the machine speed and $V_{12}$ specifies the speed of the old paper reel which, for illustrative reasons, are drawn at a small distance from each other, but at the beginning of the splice operation are substantially equal.

The new paper reel 8 is accelerated by the first drive means 24 in such a way that, at a time t1, it reaches a circumferential surface speed $V_8$ which substantially corresponds to a predefined minimum synchronization speed $V_{sync}$ which, for example, lies in the region of 0.5 m/s.

After a marking 36 identifying the web start on the new paper reel 8 has been detected by a sensor 34, the level of the sensor signal S34 rises briefly. The signal S34 from the sensor 34 is used for a prior calculation of the time t2 at which the speed $V_8$ of the new paper reel 8 is retarded down from the synchronization speed $V_{sync}$ to a minimum splice speed $V_{splice}$. Shortly after the surface speed $V_8$ of the new paper reel 8 has reached the minimum splice speed $V_{splice}$, at a time t3, the old paper reel 12 is accelerated, at a time t4, to a speed $V_{12}$ which substantially corresponds to the minimum splice speed $V_{splice}$. As FIG. 2 reveals, the speed $V_{22}$ at which the dancer roll 22 moves is increased, in accordance with the speed $V_{12}$ of the old paper reel 12, in order to absorb the sag of the old paper web 14 which is produced by the acceleration of the old paper reel 12 at the time t4. For illustrative reasons, the speed $V_{22}$ of the dancer roll 22 has been shown separately with its own scale in FIG. 2.

Figure 2:
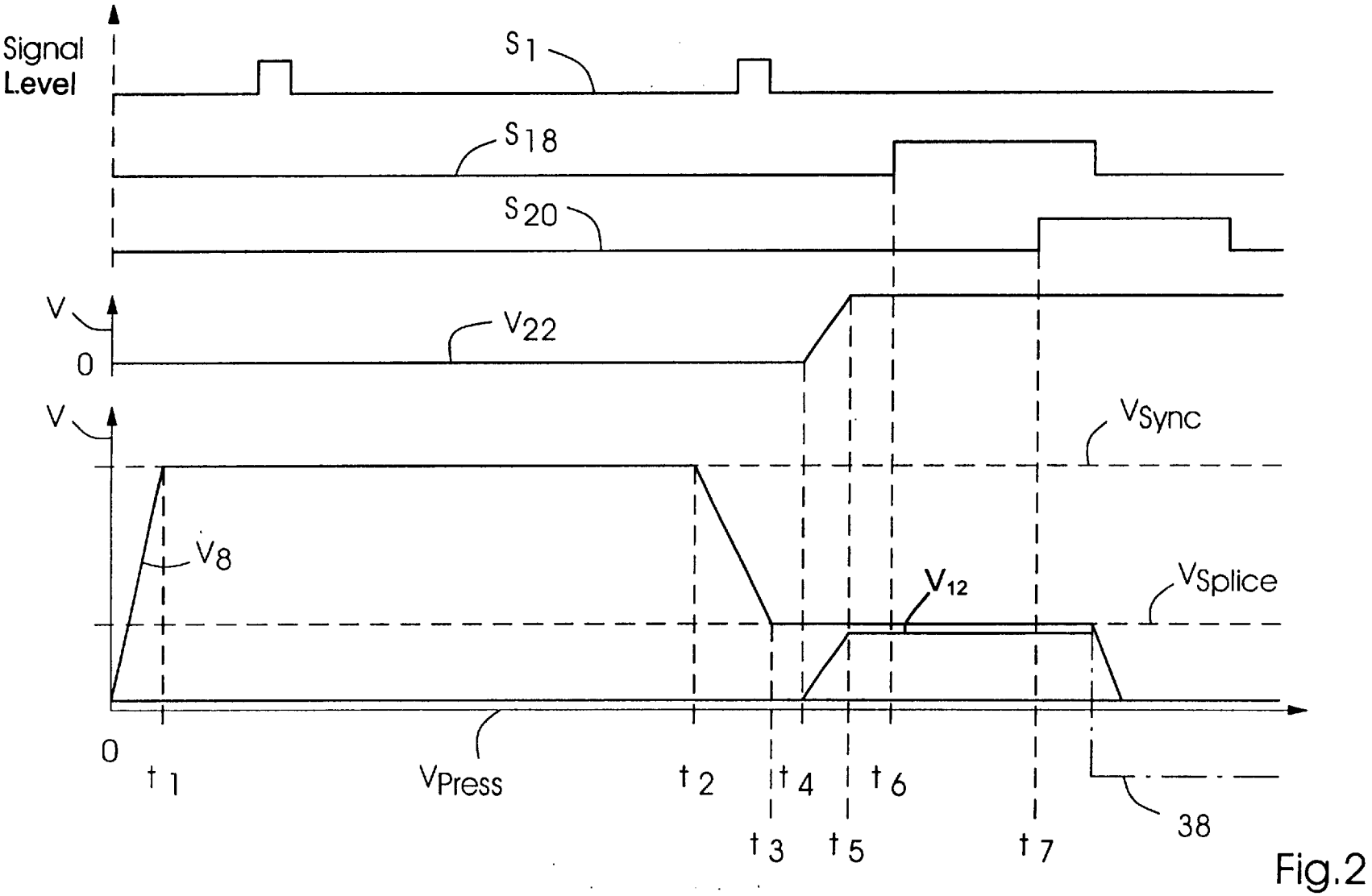
FIG. 2 shows a graph relating to the processes, which occur over time, when using the flying reel changer.

As FIG. 2 further reveals, at time t5, the old paper web 14 and the circumferential surface of the new paper reel 8 are moving at the minimum splice speed $V_{splice}$. A short time after time t5, specifically at time t6, the pressure roll 18 is set against the new paper reel 8 to press the old paper web 14 against the circumferential surface of the new paper reel 8 while the start of the new paper reel 8, provided with an adhesive section, is located in the area of the splice head 16. The activation of the pressure roll 18 is illustrated schematically by the course of the signal level $S_{18}$.

After the old paper web 14 has been joined to the start of the paper web of the new paper reel 8, the impact knife 20 is actuated at a time t7 and the old paper web 14 is severed upstream of the pressure roll 18. The activation of the impact knife 20 is illustrated schematically in FIG. 2 by using the signal level $S_{20}$, which, for example, is supplied to the pneumatic cylinders, that is to say generally to the actuating elements for the impact knife 20.

Following this, the speed $V_{12}$ of the old paper reel 12 is reduced to zero again by the braking means 32, and the pressure roll 18 is moved back into the initial position. According to a preferred embodiment of the invention, the second drive means 30 can be made to rotate the old paper reel 12 in the opposite direction, in order to wind up the remainder of the old paper web 14, which is indicated schematically in FIG. 2 by the dashed-dotted line 38.

The times t1 to t7, at which the individual actions are performed as shown in FIG. 1, are preferably all calculated in advance by a central control and regulating device (not shown).

I claim:

1. A flying reel changer for joining a beginning of a new paper web of a new paper reel to an outgoing old paper web in a web-fed rotary printing machine during standstill operation of the printing machine or during crawl operation of the printing machine, the flying reel changer comprising:

a dancer roll over which the old paper web of the old paper reel is led;

a first drive device for rotating the new paper reel at a minimum splice speed;

a second drive device for accelerating the old paper reel from a first state to a speed that substantially corresponds to the minimum splice speed, the first state selected from the group consisting of a standstill and a speed corresponding to a crawl speed of the printing machine;

an actuating device which, during acceleration of the old paper reel from the first state, moves said dancer roll such that a substantially uniform tension is maintained in the old paper web; and a joining device for joining the old paper web and the new paper web together while the old paper web and the new paper web are moving at the minimum splice speed.

2. The flying reel changer according to claim 1, comprising:

a first braking device;

said first drive device being controlled to accelerate the new paper reel to a minimum synchronization speed; and said first braking device being controlled to subsequently brake the new paper reel from the minimum synchronization speed down to the minimum splice speed.

3. The flying reel changer according to claim 2, wherein said second drive means accelerates the old paper reel after the new paper reel has reached the minimum splice speed.

4. The flying reel changer according to claim 1, wherein:

said joining device includes a pressing device selected from the group consisting of a pressure roll, a brush roll, and a brush strip; and said pressing device presses the old paper web onto an adhesive section of the new paper reel.

5. The flying reel changer according to claim 1, comprising:

a sensor for detecting markings provided on the new paper reel;

said sensor generating signals for determining a position of the new paper reel.

6. A method of joining the beginning of a new paper web of a new paper reel to an outgoing old paper web of an old paper reel in a web-fed rotary printing machine, the method which comprises:

leading the old paper web over a dancer roll in a flying reel changer of the web-fed rotary printing machine;

rotating the new paper reel at a minimum splice speed;

accelerating the old paper reel from a first state to a speed that substantially corresponds to the minimum splice speed;

selecting the first state from the group consisting of a standstill and a speed corresponding to a crawl speed of the printing machine;

while performing the accelerating step, simultaneously moving the dancer roll such that a substantially uniform tension is maintained in the old paper web;

joining the old paper web and the new paper web together while the old paper web and the new paper web are moving at the minimum splice speed; and performing the joining step while the printing machine is in an operating condition selected from the group consisting of a standstill condition and a crawl condition.

7. The method according to claim 6, which comprises:

accelerating the new paper reel to a minimum synchronization speed and then braking the new paper reel from the minimum synchronization speed down to the minimum splice speed.

8. The method according to claim 7, which comprises after the new paper reel has reached the minimum splice speed, initiating the step of accelerating the old paper reel.

9. The method according to claim 7, which comprises providing the synchronization speed to be about 0.5 m/s.

10. The method according to claim 9, which comprises after the new paper reel has reached the minimum splice speed, initiating the step of accelerating the old paper reel.

11. The method according to claim 6, which comprises providing the synchronization speed to be in a range from 0.1 m/s to 0.4 m/s.

12. The method according to claim 6, which comprises:

providing the new paper web with an adhesive section; and joining the old paper web with the new paper web by pressing the old paper web onto the adhesive section of the new paper reel using a pressing device selected from the group consisting of a pressure roll, a brush roll, and a brush strip.

13. The method according to claim 6, which comprises:

providing markings on the new paper reel;

with a sensor, registering the markings to determine a position of the new paper reel and generating marking signals; and supplying the marking signals to a central control device for controlling the joining step.

* * * * *